US009657543B2

(12) United States Patent
Fripp et al.

(10) Patent No.: US 9,657,543 B2
(45) Date of Patent: May 23, 2017

(54) WELLBORE ISOLATION DEVICE CONTAINING A SUBSTANCE THAT UNDERGOES A PHASE TRANSITION

(71) Applicant: HALLIBURTON ENERGY SERVICES, INC., Houston, TX (US)

(72) Inventors: Michael L. Fripp, Carrollton, TX (US); Zachary W. Walton, Carrollton, TX (US); Matthew T. Howell, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 239 days.

(21) Appl. No.: 13/957,816

(22) Filed: Aug. 2, 2013

(65) Prior Publication Data

US 2013/0333891 A1 Dec. 19, 2013

Related U.S. Application Data

(63) Continuation-in-part of application No. 13/523,095, filed on Jun. 14, 2012, and a continuation-in-part of (Continued)

(51) Int. Cl.
*E21B 23/00* (2006.01)
*E21B 29/02* (2006.01)
(Continued)

(52) U.S. Cl.
CPC ..... *E21B 29/02* (2013.01); *E21B 33/1208* (2013.01); *E21B 33/134* (2013.01); (Continued)

(58) Field of Classification Search
CPC ..... E21B 29/00; E21B 33/12; E21B 33/13; E21B 17/1014; E21B 23/06; E21B 36/00
See application file for complete search history.

(56) References Cited

U.S. PATENT DOCUMENTS 4,716,964 A 1/1988 Erbstoesser et al.
6,237,688 B1 5/2001 Burleson et al.
(Continued)

FOREIGN PATENT DOCUMENTS

GB 2480869 A 12/2011
WO 2014100141 A2 6/2014

OTHER PUBLICATIONS

European Patent Office, Communication of Supplementary European Search Report, Appn. No. EP13804991, Jul. 26, 2016.
(Continued)

*Primary Examiner* — Zakiya W Bates
(74) *Attorney, Agent, or Firm* — McGuireWoods LLP

(57) ABSTRACT

A wellbore isolation device comprises: a substance, wherein the substance: (A) is a plastic; and (B) undergoes a phase transition at a phase transition temperature, wherein the temperature surrounding the wellbore isolation device is increased or allowed to increase to a temperature that is greater than or equal to the phase transition temperature. A method of removing a wellbore isolation device comprises: causing or allowing the temperature surrounding the wellbore isolation device to increase; and allowing at least a portion of the substance to undergo the phase transformation. A method of inhibiting or preventing fluid flow in a wellbore comprises: decreasing the temperature of at least a portion of the wellbore; positioning the wellbore isolation device in the at least a portion of the wellbore; and causing or allowing the temperature surrounding the wellbore isolation device to increase.

20 Claims, 1 Drawing Sheet

Related U.S. Application Data application No. PCT/US2013/027539, filed on Feb. 24, 2013.

(51) Int. Cl.

| | |
|---|---|
| ***E21B 34/06*** | (2006.01) |
| ***E21B 43/26*** | (2006.01) |
| ***E21B 33/12*** | (2006.01) |
| ***E21B 33/134*** | (2006.01) |
| *E21B 17/10* | (2006.01) |

(52) U.S. Cl.

CPC ..... *E21B 34/06* (2013.01); *E21B 43/26* (2013.01); *E21B 17/1014* (2013.01); *E21B 23/00* (2013.01)

(56) References Cited

U.S. PATENT DOCUMENTS

| | | | | |
|---|---|---|---|---|
| 7,350,582 | B2 | 4/2008 | McKeachnie et al. | |
| 7,353,879 | B2 | 4/2008 | Todd et al. | |
| 7,798,236 | B2 | 9/2010 | McKeachnie et al. | |
| 2006/0037748 | A1 | 2/2006 | Wardlaw et al. | |
| 2007/0199693 | A1 | 8/2007 | Kunz | |
| 2008/0093073 | A1* | 4/2008 | Bustos | C09K 8/68 166/279 |
| 2009/0226340 | A1 | 9/2009 | Marya | |
| 2010/0032151 | A1 | 2/2010 | Duphorne | |
| 2010/0078173 | A1* | 4/2010 | Buytaert | E21B 17/1014 166/302 |
| 2010/0236785 | A1* | 9/2010 | Collis et al. | 166/339 |
| 2011/0011591 | A1 | 1/2011 | Watters et al. | |
| 2011/0094755 | A1 | 4/2011 | Corbett et al. | |
| 2011/0213101 | A1* | 9/2011 | Shi | 525/437 |
| 2011/0278011 | A1* | 11/2011 | Crainich, Jr. | C04B 40/0092 166/310 |
| 2012/0118583 | A1 | 5/2012 | Johnson et al. | |
| 2012/0181032 | A1* | 7/2012 | Naedler | E21B 43/26 166/308.1 |
| 2013/0081801 | A1 | 4/2013 | Liang et al. | |
| 2013/0333890 | A1 | 12/2013 | Dagenais | |

OTHER PUBLICATIONS

Degradable Casing Perforation Ball Sealers and Methods for Use in Well Treatment, IPCOM000215741D, Mar. 7, 2012. Available at: http://priorartdatabase.com/IPCOM/000215741.

Solu-Plugs—Delayed Frac Plugs, IPCOM000176055D, Nov. 3, 2008. Available at: http://www.ip.com/pubview/IPCOM000176055D.

European Patent Office, Communication, Application No. 14832879.2, Feb. 23, 2017.

European Patent Office, Communication, European Extended Search Report, Application No. 1487-021.5, Mar. 30, 2017.

* cited by examiner

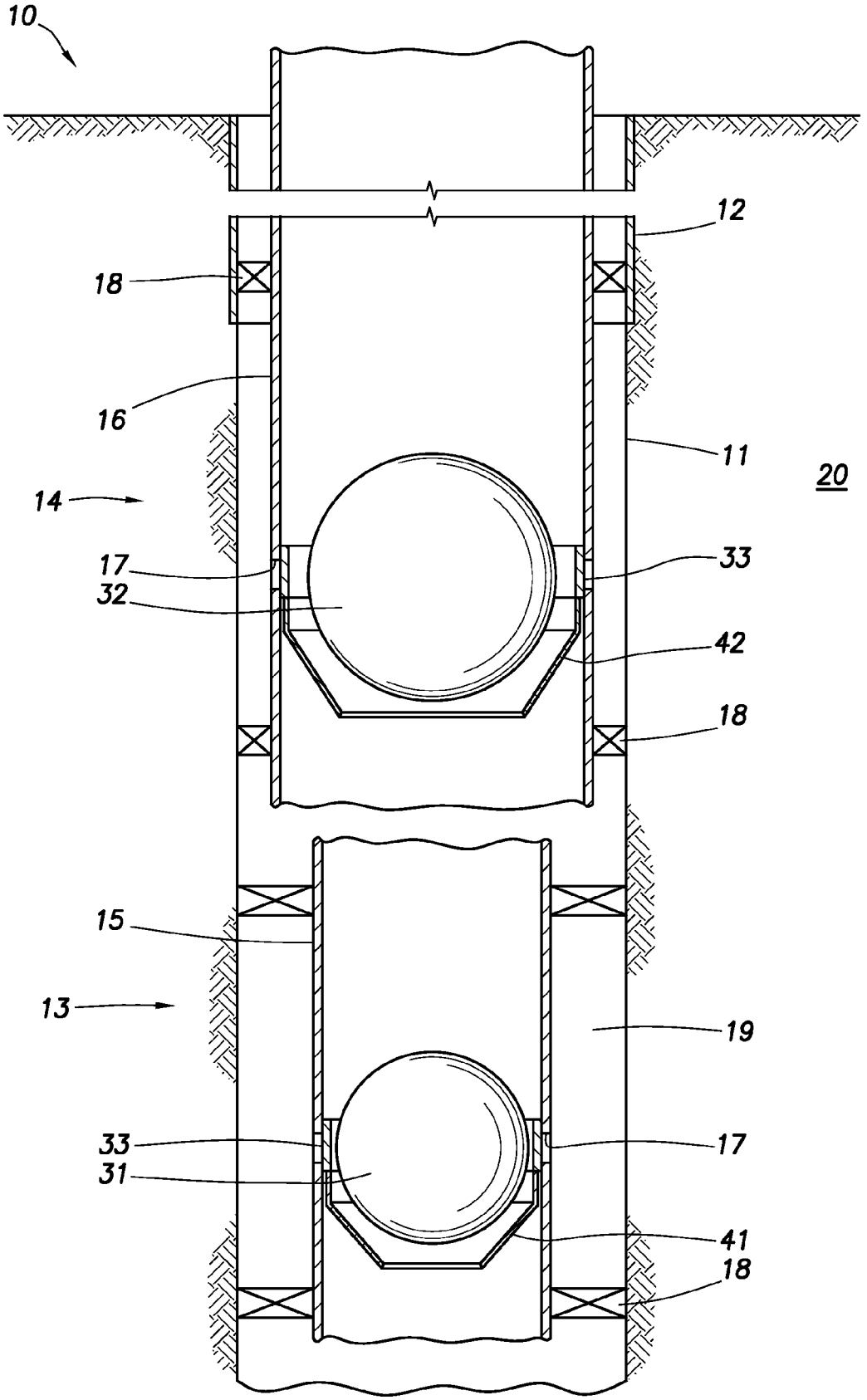
10
12
18
16
11
20
14
17
33
32
42
18
15
13
19
33
17
31
41
18

WELLBORE ISOLATION DEVICE CONTAINING A SUBSTANCE THAT UNDERGOES A PHASE TRANSITION

TECHNICAL FIELD

An isolation device and methods of using and removing the isolation device are provided. According to an embodiment, the isolation device is used in an oil or gas operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

The FIGURE depicts a well system containing more than one isolation device.

DETAILED DESCRIPTION

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more compositions, substances, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (21.7° C.) and a pressure of one atmosphere "atm" (0.1 megapascals "MPa"). A fluid can be a liquid or gas.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A "well" can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device. An isolation device can be used for zonal isolation and functions to block fluid flow within a tubular, such as a tubing string, or within an annulus. The blockage of fluid flow prevents the fluid from flowing into the zones located downstream of the isolation device and isolates the zone of interest. As used herein, the relative term "downstream" means at a location further away from a wellhead. In this manner, treatment techniques can be performed within the zone of interest.

Common isolation devices include, but are not limited to, a ball, a plug, a bridge plug, a wiper plug, and a packer. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished, for example, via a ball and seat by dropping the ball from the wellhead onto the seat that is located within the wellbore. The ball engages with the seat, and the seal created by this engagement prevents fluid communication into other zones downstream of the ball and seat. In order to treat more than one zone using a ball and seat, the wellbore can contain more than one ball seat. For example, a seat can be located within each zone. Generally, the inner diameter (I.D.) of the tubing string where the ball seats are located is different for each zone. For example, the I.D. of the tubing string sequentially decreases at each zone, moving from the wellhead to the bottom of the well. In this manner, a smaller ball is first dropped into a first zone that is the farthest downstream; that zone is treated; a slightly larger ball is then dropped into another zone that is located upstream of the first zone; that zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream zones. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more zones. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device. Yet, another way to remove an isolation device is to contact the device with a solvent, such as an acid, thus dissolving all or a portion of the device.

However, some of the disadvantages to using traditional methods to remove a retrievable isolation device include: it can be difficult and time consuming to use a retrieval tool; milling can be time consuming and costly; and premature dissolution of the isolation device can occur. For example, premature dissolution can occur if acidic fluids are used in the well prior to the time at which it is desired to dissolve the isolation device.

It is desirable to easily and efficiently remove an isolation device after the device has been used for its intended purpose. A novel method of removing an isolation device includes causing or allowing an increase in the wellbore temperature surrounding the isolation device. The isolation device includes a substance. The substance undergoes a phase transition at the phase transition temperature. The wellbore temperature is increased to at least the phase transition temperature after the isolation device is no longer needed.

The bottomhole temperature of a well varies significantly, depending on the subterranean formation, and can range from about 100° F. to about 600° F. (about 37.8° C. to about 315.6° C.). As used herein, the term "bottomhole" means at the location of the isolation device. It is often desirable to have a substance undergo a phase transition at the bottomhole temperature of a well. As used herein, a "phase transition" means any change that occurs to the physical properties of the substance. As used herein, a "phase transition" can include, without limitation, a change in the phase of the substance (i.e., from a solid to a liquid or semi-liquid, from a liquid or semi-liquid to a gas, etc.), a glass transition, a change in the amount of crystallinity of the substance, physical changes to the amorphous and/or crystalline portions of the substance, and any combinations thereof. A substance will undergo a phase transition at a "phase transition temperature." As used herein, a "phase transition temperature" includes a single temperature and a range of temperatures at which the substance undergoes a phase transition. Therefore, it is not necessary to continually specify that the phase transition temperature can be a single temperature or a range of temperatures throughout. By way of example, a substance will have a glass transition temperature or range of temperatures, symbolized as $T_g$. The $T_g$ of a substance is generally lower than its melting temperature $T_m$. The glass transition can occur in the amorphous regions of the substance.

The glass transition, also called the glass-liquid transition, is a reversible transition in one or more regions of a substance from a hard solid into a molten or rubber-like state at the glass transition temperature ($T_g$). Crystallinity refers to the degree of structural order in a solid. A substance can include both amorphous portions or regions and crystalline portions or regions. In these instances, the crystallinity usually means the percentage of the volume of the substance that is crystalline. The crystalline portions of a substance contain atoms or molecules that are arranged in a regular, periodic manner.

Polymers commonly include amorphous regions and crystalline regions. A polymer is a large molecule composed of repeating units, typically connected by covalent chemical bonds. A polymer is formed from monomers. During the formation of the polymer, some chemical groups can be lost from each monomer. The piece of the monomer that is incorporated into the polymer is known as the repeating unit or monomer residue. The backbone of the polymer is the continuous link between the monomer residues. The polymer can also contain functional groups or side chains connected to the backbone at various locations along the backbone. Polymer nomenclature is generally based upon the type of monomer residues comprising the polymer. A polymer formed from one type of monomer residue is called a homopolymer. A copolymer is formed from two or more different types of monomer residues. The number of repeating units of a polymer is referred to as the chain length of the polymer. The number of repeating units of a polymer can range from approximately 11 to greater than 10,000. In a copolymer, the repeating units from each of the monomer residues can be arranged in various manners along the polymer chain. For example, the repeating units can be random, alternating, periodic, or block. The conditions of the polymerization reaction can be adjusted to help control the average number of repeating units (the average chain length) of the polymer. As used herein, a "polymer" can include a cross-linked polymer. As used herein, a "cross link" or "cross linking" is a connection between two or more polymer molecules. A cross-link between two or more polymer molecules can be formed by a direct interaction between the polymer molecules, or conventionally, by using a cross-linking agent that reacts with the polymer molecules to link the polymer molecules.

A polymer has an average molecular weight, which is directly related to the average chain length of the polymer. For a copolymer, each of the monomers will be repeated a certain number of times (number of repeating units). The average molecular weight for a copolymer can be expressed as follows:

$$\text{Avg. molecular weight}=(\text{M.W.}m_1*\text{RU } m_1)+(\text{M.W.}m_2*\text{RU } m_2)$$

where $\text{M.W.m}_1$ is the molecular weight of the first monomer; RU $m_1$ is the number of repeating units of the first monomer; $\text{M.W.m}_2$ is the molecular weight of the second monomer; and RU $m_2$ is the number of repeating units of the second monomer. Of course, a terpolymer would include three monomers, a tetra polymer would include four monomers, and so on.

Prior to a phase transition, the substance of the isolation device is capable of withstanding a pressure differential in the wellbore. As used herein, the term "withstanding" means that the substance does not crack, break, extrude, or collapse. The pressure differential can be the bottomhole pressure of the subterranean formation across the device. The bottomhole temperature of the wellbore can also be cooled to increase the strength of the substance such that the substance withstands the pressure differential. After the substance undergoes at least one phase transition, then the strength of the substance is decreased. The decrease in strength can be, without limitation, a result of any of the following: the substance transforms from a solid to a liquid or semi-liquid; the substance dissolves; the substance degrades; the substance is capable of breaking into smaller pieces; and/or the stiffness of the substance is decreased. For substances, degradation means the decomposition of chemical compounds. One example of degradation for a polymer is hydrolytic degradation of the polymer molecule. The substance, for example in the form of a ball, can slough off or lose outer layers of the ball due to the degradation of the substance. This in turn causes the substance and the ball to lose strength.

According to an embodiment, A wellbore isolation device comprising: a substance, wherein the substance: (A) is a plastic; and (B) undergoes a phase transition at a phase transition temperature.

According to another embodiment, a method of removing a wellbore isolation device comprises: causing or allowing the temperature surrounding the wellbore isolation device to increase, wherein the temperature surrounding the wellbore isolation device is increased or allowed to increase to a temperature that is greater than or equal to the phase transition temperature; and allowing at least a portion of the substance to undergo the phase transformation.

According to yet another embodiment, a method of inhibiting or preventing fluid flow in a wellbore comprises: (A) decreasing the temperature of at least a portion of the wellbore; (B) positioning a wellbore isolation device in the at least a portion of the wellbore, wherein the isolation device is positioned after decreasing the temperature, and wherein the wellbore isolation device comprises a substance, wherein the substance: (i) is a plastic; and (ii) undergoes a phase transition at a phase transition temperature, wherein the temperature of the at least the portion of the wellbore is decreased to a temperature that is less than the phase transition temperature; (C) causing or allowing the temperature surrounding the wellbore isolation device to increase, wherein the temperature surrounding the wellbore isolation device is increased or allowed to increase after positioning the wellbore isolation device, and wherein the temperature surrounding the wellbore isolation device is increased or allowed to increase to a temperature that is greater than or equal to the phase transition temperature; and (D) allowing at least a portion of the substance to undergo the phase transformation.

Any discussion of the embodiments regarding the isolation device or any component related to the isolation device (e.g., the first composition) is intended to apply to all of the apparatus and method embodiments.

Turning to the FIGURE depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A first section of tubing string 15 can be installed in the wellbore 11. A second section of tubing string 16 (as well as multiple other sections of tubing string, not shown) can be installed in the wellbore 11. The well system 10 can comprise at least a first zone 13 and a second zone 14. The well system 10 can also include more than two zones, for example, the well system 10 can further include a third zone, a fourth zone, and so on. The well system 10 can further include one or more packers 18. The packers 18 can be used in addition to the isolation device to isolate each zone of the wellbore 11. The isolation device can be the packers 18. The packers 18 can be used to help prevent fluid flow between one or more zones (e.g., between the first zone 13 and the second zone 14) via an annulus 19. The tubing string 15/16 can also include one or more ports 17. One or more ports 17 can be located in each section of the tubing string. Moreover, not every section of the tubing string needs to include one or more ports 17. For example, the first section of tubing string 15 can include one or more ports 17, while the second section of tubing string 16 does not contain a port. In this manner, fluid flow into the annulus 19 for a particular section can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

As can be seen in the FIGURE, the first section of tubing string 15 can be located within the first zone 13 and the second section of tubing string 16 can be located within the second zone 14. The isolation device can be, without limitation, an occlusion and a baffle, a plug, a bridge plug, a wiper plug, and a packer. The occlusion can be a frac ball and the baffle can be a ball seat. A frac ball is a ball used in conjunction with hydraulic fracturing operations. The frac ball and seat can isolate one zone of the wellbore from another zone of the wellbore to allow a fracturing operation to be performed in the desired wellbore zone. As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string. When the first section of tubing string 15 is located downstream of the second section of tubing string 16, then the inner diameter (I.D.) of the first section of tubing string 15 can be less than the I.D. of the second section of tubing string 16. In this manner, a first ball 31 can be placed into the first section of tubing string 15. The first ball 31 can have a smaller diameter than a second ball 32. The first ball 31 can engage a first seat 41. Fluid can now be temporarily restricted or prevented from flowing into any zones located downstream of the first zone 13. In the event it is desirable to temporarily restrict or prevent fluid flow into any zones located downstream of the second zone 14, the second ball 32 can be placed into second section of tubing string 16 and will be prevented from falling into the first section of tubing string 15 via the second seat 42 or because the second ball 32 has a larger outer diameter (O.D.) than the I.D. of the first section of tubing string 15. The second ball 32 can engage the second seat 42. The ball (whether it be a first ball 31 or a second ball 32) can shift a downhole tool during positioning the ball in the portion of the wellbore. For example, the ball can engage a sliding sleeve 33 during placement. This engagement with the sliding sleeve 33 can cause the sliding sleeve to move; thus, opening a port 17 located adjacent to the seat. The ball can also include a magnetic signature that, when in proximity to the tool, triggers an electronic assembly on the tool to cause the tool to shift. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular zone. As such, a fluid can be produced from the subterranean formation 20 or injected into the formation.

According to an embodiment, the isolation device is at least partially capable of restricting or preventing fluid flow between a first zone 13 and a second zone 14. By way of example, the isolation device can be used to restrict or prevent fluid flow between different zones within the tubing string while packers 18 and/or cement can be used to restrict or prevent fluid flow between different zones within the annulus 19. The isolation device can also be the only device used to prevent or restrict fluid flow between zones. By way of another example, there can also be two or more isolation devices positioned within a given zone. According to this example, one isolation device can be a packer while the other isolation device can be a ball and seat or a bridge plug. The first zone 13 can be located upstream or downstream of the second zone 14. In this manner, depending on the oil or gas operation, fluid is restricted or prevented from flowing downstream or upstream into the second zone 14.

The isolation device comprises a substance. The substance is a plastic. According to an embodiment, the plastic is a thermoplastic or a wax. The substance can be a polymer. The substance can be amorphous, crystalline, or combinations thereof in any proportion. The crystallinity (i.e., the volume % of the substance that is crystalline) can vary and can be pre-selected. For example, the polymerization reaction for a polymeric substance can be controlled to provide a lower or higher volume % of crystalline regions. The polymer can contain amorphous and crystalline regions. The polymer can be a homopolymer or a copolymer. For a copolymer, the repeating units can be random, alternating, periodic, or block. The polymer can be a cross-linked polymer. The polymer can be an aliphatic polyester or a polyanhydride. Suitable examples of thermoplastic polymers include, but are not limited to, polyglycolic acid (PGA) or polylactic acid (PLA). The polymer can also include non-reactive side chains. The addition of non-reactive side chains can be used to adjust the phase transition temperature of the substance. By way of example, the addition of non-reactive side chains can decrease the glass-transition temperature ($T_g$) of the substance. Moreover, the monomer residues and ratios thereof can be adjusted to provide a desired phase transition temperature of the substance.

The substance undergoes a phase transition at a phase transition temperature. As discussed earlier, the phase transition temperature can be a single temperature or a range of temperatures. By way of example, PGA has a glass-transition temperature in the range of 95° F. to 104° F. (35° C. to 40° C.). The phase transition can be a change in the phase of the substance (e.g., a solid/liquid phase transition), a glass transition, a change in the amount of crystallinity of the substance, physical changes to the amorphous and/or crystalline portions of the substance, and any combinations thereof. The solid/liquid phase transition is the transition of the substance from a solid to a liquid or semi-liquid or vice versa. The substance can also have more than one phase transition temperature, wherein the phase transitions are different. By way of example, the substance can have a phase transition of a glass transition and a change in the phase of the substance (e.g., the solid/liquid phase transition). The glass transition temperature can be less than the solid/liquid phase transition temperature. According to this embodiment, the substance can undergo more than one phase transition, wherein the phase transitions are different. Accordingly, the substance can undergo at least two of the following changes: a solid/liquid phase transition, a glass transition, a change in the amount of crystallinity of the substance, and physical changes to the amorphous and/or crystalline portions of the substance.

The methods can include decreasing the temperature of at least a portion of the wellbore. The decrease in temperature can be performed prior to positioning the wellbore isolation device in the at least the portion of the wellbore. The step of decreasing can include introducing a cooling fluid into the portion of the wellbore. The cooling fluid can be a variety of types of fluids used in oil or gas operations, for example, drilling fluids, injection fluids, fracturing fluids, work-over fluids, acidizing fluids, gravel packing fluids, completion fluids, and stimulation fluids. According to this embodiment, the cooling fluid being introduced into the wellbore 11 has a surface temperature that is less than the phase transformation temperature of the substance. By way of example, fracturing fluids can cool the bottomhole temperature of the portion of the wellbore by over 100° F. (37.8° C.). By way of another example, the fracturing fluids can cool the bottomhole temperature to within 10° F. (−12.2° C.) of the surface temperature of the injected fluid. The temperature of the portion of the wellbore is decreased to a temperature that is less than or equal to the phase transition temperature of the substance. According to an embodiment, the temperature of the portion of the wellbore is decreased to a temperature that is less than glass-transition temperature and/or the solid/liquid phase transition temperature of the substance. In this manner, the substance is initially subjected to a wellbore temperature that is less than any of the phase transition temperatures of the substance.

The methods can also include the step of positioning the wellbore isolation device in the at least a portion of the wellbore. The step of positioning can be performed after the step of decreasing the temperature of at least a portion of the wellbore. According to another embodiment, the methods can further include the step of positioning the isolation device in a portion of the wellbore 11, wherein the step of positioning is performed prior to the step of increasing the temperature surrounding the wellbore isolation device. According to another embodiment, the methods do not include the step of decreasing the temperature of the at least the portion of the wellbore. This embodiment can be useful when the portion of the wellbore already has a temperature that is less than any of the phase transition temperatures of the substance. Accordingly, it may not be necessary to cool the portion of the wellbore to a temperature that is less than the phase transition temperature of the substance. This may be applicable when the isolation device is introduced into an upper portion of the wellbore, where wellbore temperatures in this portion may be less than the substance's phase transition temperature. The step of positioning can include installing the wellbore isolation device in the portion of the wellbore. More than one isolation device can also be positioned in multiple portions of the wellbore. According to an embodiment, the isolation device is positioned such that it is capable of restricting or preventing fluid flow within a portion of the wellbore. The isolation device can also be positioned such that a first zone is isolated from a second zone.

The methods include causing or allowing the temperature surrounding the wellbore isolation device to increase, wherein the temperature surrounding the wellbore isolation device is increased or allowed to increase to a temperature that is greater than or equal to the phase transition temperature of the substance. The temperature can be increased or allowed to increase after the positioning the wellbore isolation device in the at least the portion of the wellbore. As used herein, the phrase "surrounding the wellbore isolation device" means the area immediately adjacent to at least a portion of the isolation device. By way of example, the isolation device can be surrounded on the top, bottom, and sides of the device. At least one area surrounding the isolation device can have an increase in temperature at one time and another area surrounding the isolation device can have an increase in temperature at another time. For example, the area immediately adjacent to the top portion of the isolation device can have an increase in temperature and then the area immediately adjacent to the bottom portion of the device can later have an increase in temperature.

The causation of the temperature increase can include introducing a fluid into the bottomhole portion of the wellbore 11. The fluid can be a liquid or a gas. The fluid can be a heated fluid. According to an embodiment, prior to and during introduction, the fluid has a temperature greater than or equal to the phase transition temperature of the substance. The allowance of the temperature increase can include a cessation of the cooling fluid into the portion of the wellbore 11. After the cooling fluid is no longer being introduced into the portion of the wellbore 11, the fluid no longer cools the area surrounding the isolation device, and the subterranean formation 20 can increase the bottomhole temperature and the bottomhole temperature will gradually revert to the formation temperature. According to these embodiments, the subterranean formation 20 is capable of increasing the bottomhole temperature to a temperature greater than or equal to the phase transformation temperature of the substance.

According to an embodiment, the substance is capable of withstanding a specific pressure differential. As used herein, the term "withstanding" means that the substance does not crack, break, extrude, or collapse. The pressure differential can be the bottomhole pressure of the subterranean formation 20 across the device. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the isolation device, can create a higher pressure above or below, respectively, of the isolation device. Pressure differentials can range from about 100 to over 10,000 psi (about 0.7 to over 68.9 MPa). The portion of the wellbore preferably has a temperature less than the phase transition temperature of the substance at least prior to and during positioning the isolation device in the wellbore portion. In this manner, the substance either maintains or has an increase in strength due to the temperature of the portion of the wellbore and is capable of withstanding the specific pressure differential. As a result, the isolation device can be used to maintain zonal isolation within the wellbore.

The substance undergoes the phase transition at the phase transition temperature. The methods include allowing at least a portion of the substance to undergo the phase transition. The entirety of the substance can also undergo the phase transition at the phase transition temperature. According to an embodiment, during and after the substance undergoes the phase transition the strength of the substance is decreased. The decrease in strength can be, without limitation, a result of any of the following: the substance transforms from a solid to a liquid or semi-liquid; the substance dissolves; the substance degrades; the substance is capable of breaking into smaller pieces; and/or the stiffness of the substance is decreased. According to an embodiment, the substance degrades via hydrolytic degradation of the polymer molecule. The substance, for example in the form of a ball, can slough off or lose outer layers of the ball due to the degradation of the substance. This in turn causes the substance and the ball to lose strength. After the substance loses strength, the structural integrity of the isolation device can decrease. This allows the isolation device to be removed from the wellbore with minimal effort and expense.

At least the portion of the substance can undergo the phase transition in a desired amount of time. The desired amount of time can be pre-determined, based in part, on the specific oil or gas operation to be performed. The desired amount of time can be in the range from about 1 hour to about 2 months. As discussed previously, the substance, the monomer residue(s) selected and possible ratios thereof, and the addition of non-reactive side chains can be selected to yield a substance with a desired phase transition temperature. The desired phase transition temperature can be determined based on information from a specific subterranean formation. For example, if the formation has a bottomhole temperature of 400° F. (204.4° C.), then the factors listed above can be selected to yield a substance with a phase transition temperature of less than 400° F. (204.4° C.) (e.g., 370° F. (187.8° C.) to 390° F. (198.9° C.). In this manner, during operations, a cooling fluid can generally maintain the bottomhole temperature less than the phase transition temperature. Then, at the desired time, the cooling fluid can be stopped, the fluid no longer cools the area surrounding the isolation device, the formation will increase the bottomhole temperature to approximately 400° F. (204.4° C.), and at least the portion of the substance will undergo the phase transition. Of course, a fluid heated to greater than or equal to the phase transition temperature of the substance can also be introduced into the area surrounding the isolation device at the desired time to cause the phase transition. Moreover, more than one fluid can be introduced into the surrounding area. Multiple fluids, each having a different temperature may be useful when more than phase transition of the substance is desirable. In this manner, a first fluid can be introduced to cause the substance to undergo a glass transition. Then a second fluid having a higher temperature than the first fluid can be introduced to cause the substance to undergo a solid/liquid phase transition (as the glass-transition temperature is generally less than the solid/liquid phase transition temperature).

Tracers can be used to help determine whether the substance has undergone the phase transition. The tracers can be, without limitation, radioactive, chemical, electronic, or acoustic. For example, if it is desired that the substance undergoes the phase transition such that the isolation device can be flowed from the wellbore 11 within 5 days and information from a tracer indicates that the isolation device has not moved from its original location, then a fluid having a higher temperature than previous fluids can be introduced into the wellbore to contact the substance. By contrast, if the rate of the phase transition is occurring too quickly, then the temperature of the fluid can be decreased to retard the phase transition of the composition. A tracer can be useful in determining real-time information on whether the substance has partially or completely undergone the phase transition. By being able to monitor the presence of the tracer, workers at the surface can make on-the-fly decisions that can affect the phase transition rate of the substance. Workers can also monitor whether the substance has undergone more than one phase transition, for example a glass transition and a solid/liquid phase transition.

The methods can further include removing all or a portion of the isolation device, wherein the step of removing is performed after the step of allowing the at least a portion of the substance to undergo the phase transition or after the step of causing or allowing the temperature surrounding the wellbore isolation device to increase. The step of removing can include flowing at least a portion of the isolation device from the wellbore 11. For a ball and seat isolation device, the ball can at least lose strength after undergoing the phase transition. The substance can, without limitation, break apart, dissolve, degrade, or melt into a liquid or semi-liquid. Now, the entire ball may cease to exist for dissolution, degradation, or melting; or the ball may break into smaller pieces, such that the pieces of the ball can be flowed from the wellbore. For a bridge plug or packer, for example, the substance can be used in an area on the device such that the substance helps to anchor the device to the casing, wall of the wellbore, or inside of a tubing string. Now after the strength of the substance has decreased due to the phase transition, the remaining portions of the device can be easily retrieved from the wellbore, for example, via a retrieval tool.

According to another embodiment, a method of hydraulically fracturing at least a portion of a subterranean formation penetrated by a wellbore comprises: (A) decreasing the temperature of the wellbore penetrating the portion of the subterranean formation; (B) positioning a wellbore isolation device in the wellbore penetrating the portion of the subterranean formation, wherein the isolation device is positioned after decreasing the temperature, and wherein the wellbore isolation device comprises a substance, wherein the substance: (i) is a plastic; (ii) comprises polyglycolic acid; and (iii) undergoes a phase transition at a phase transition temperature, wherein the temperature of the wellbore penetrating the portion of the subterranean formation is decreased to a temperature that is less than the phase transition temperature; (C) creating one or more fractures in the portion of the subterranean formation; (D) causing or allowing the temperature surrounding the wellbore isolation device to increase, wherein the temperature surrounding the wellbore isolation device is increased or allowed to increase after creating the one or more fractures, and wherein the temperature surrounding the wellbore isolation device is increased or allowed to increase to a temperature that is greater than or equal to the phase transition temperature; and (E) allowing at least a portion of the substance to undergo the phase transformation.

This embodiment can be useful to provide temporary zonal isolation within a wellbore in order to perform a hydraulic fracturing operation. "Hydraulic fracturing," sometimes simply referred to as "fracturing," is a common stimulation treatment. A treatment fluid adapted for this purpose is sometimes referred to as a "fracturing fluid." The fracturing fluid is pumped at a sufficiently high flow rate and high pressure into the wellbore and into the subterranean formation to create or enhance a fracture in the subterranean formation. Creating a fracture means making a new fracture in the formation. Enhancing a fracture means enlarging a pre-existing fracture in the formation. Accordingly, after the isolation device is positioned in the wellbore, a hydraulic fracturing operation can be performed. There can also be more than one portion of the subterranean formation that is fractured. Therefore, more than one isolation device can be used to isolate one or more zones of the subterranean formation whereby a fracturing operation can be performed in all or some of the zones of the formation. The creation of the one or more fractures can include introducing a fracturing fluid into the wellbore. The fracturing fluid can have a temperature that is less than the phase transition temperature of the substance. In this manner, the substance is capable of withstanding a specific pressure differential. During or after the creation of the fracture(s), the temperature of the fracturing fluid can increase to a temperature that is greater than or equal to the phase transition temperature of the substance. In this manner, the substance can undergo the phase transition. Conversely, a heated fluid other than the fracturing fluid can be introduced into the wellbore in the area surrounding the isolation device to cause the substance to undergo the phase transition. This method can also include flowing at least a portion of the isolation device from the wellbore after the fracturing operation has been performed.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

introducing from a wellhead a ball, a wiper plug, or a packer into a wellbore, the ball, the wiper plug, or the packer being a solid wellbore isolation device at the wellhead;

causing or allowing the temperature surrounding the wellbore isolation device to increase, wherein the wellbore isolation device comprises a substance, wherein the substance:

(A) is a plastic polymer comprising amorphous and crystalline regions; and (B) undergoes a phase transition at a phase transition temperature, wherein the temperature surrounding the wellbore isolation device is increased or allowed to increase to a temperature that is greater than or equal to the phase transition temperature; and allowing at least a portion of the substance to undergo the phase transformation.

2. The method according to claim 1, wherein the ball is a frac ball.

3. The method according to claim 1, wherein the plastic is a thermoplastic.

4. the method of claim 1, wherein the polymer is a homopolymer or a copolymer.

5. The method according to claim 1, wherein the substance undergoes at least two of the following changes: a solid/liquid phase transition, a glass transition, a change in the amount of crystallinity of the substance, and physical changes to the amorphous and/or crystalline portions of the substance.

6. The method according to claim 1, wherein the isolation device is capable of withstanding a specific pressure differential prior to allowing the at least a portion of the substance to undergo the phase transition.

7. The method according to claim 6, wherein the pressure differential is in the range from about 100 to about 25,000 pounds force per square inch.

8. The method according to claim 1, wherein during and after the substance undergoes the phase transition the strength of the substance is decreased.

9. The method according to claim 8, wherein the decrease in strength is a result of any of the following or combinations thereof: the substance transforms from a solid to a liquid or semi-liquid; the substance dissolves; the substance degrades; the substance is capable of breaking into smaller pieces; or the stiffness of the substance is decreased.

10. The method according to claim 9, wherein the substance is a polymer, and wherein the substance degrades via hydrolytic degradation of the polymer molecule.

11. The method according to claim 1, further comprising positioning the isolation device into a portion of the wellbore, wherein the step of positioning is performed prior to causing or allowing an increase in the temperature surrounding the wellbore isolation device.

12. The method according to claim 11, wherein prior to and during positioning of the isolation device, the portion of the portion of the wellbore has a temperature less than the phase transition temperature of the substance.

13. The method according to claim 1, wherein the causation of the increase of the temperature surrounding the wellbore isolation device comprises injecting a fluid into a portion of a wellbore.

14. The method according to claim 1, wherein the allowance of the increase of the temperature surrounding the wellbore isolation device comprises a cessation of an injection of a cooling fluid into a portion of a wellbore.

15. A method of removing a wellbore isolation device comprising:

introducing from a wellhead a ball, a wiper plug, or a packer into a wellbore, the ball, the wiper plug, or the packer being a solid wellbore isolation device at the wellhead;

causing or allowing the temperature surrounding the wellbore isolation device to increase, wherein the wellbore isolation device comprises a substance, wherein the substance:

(A) is a plastic polymer comprising an aliphatic polyester or a polyanhydride; and (B) undergoes a phase transition at a phase transition temperature, wherein the temperature surrounding the wellbore isolation device is increased or allowed to increase to a temperature that is greater than or equal to the phase transition temperature; and allowing at least a portion of the substance to undergo the phase transformation.

16. The method according to claim 15, wherein the polymer is selected from the group consisting of polyglycolic acid, polylactic acid, and combinations thereof.

17. A method of removing a wellbore isolation device comprising:

introducing from a wellhead a ball, a wiper plug, or a packer into a wellbore, the ball, the wiper plug, or the packer being a solid wellbore isolation device at the wellhead; causing or allowing the temperature surrounding the wellbore isolation device to increase, wherein the wellbore isolation device comprises a substance, wherein the substance:

(A) is a plastic polymer comprising non-reactive side-chains; and (B) undergoes a phase transition at a phase transition temperature, wherein the temperature surrounding the wellbore isolation device is increased or allowed to increase to a temperature that is greater than or equal to the phase transition temperature; and allowing at least a portion of the substance to undergo the phase transformation.

18. A method of inhibiting or preventing fluid flow in a wellbore comprising:

(A) decreasing the temperature of at least a portion of the wellbore;

(B) introducing from a wellhead a ball, a wiper plug, or a packer into the wellbore, the ball, the wiper plug, or the packer being a solid wellbore isolation device at the wellhead;

(C) positioning the wellbore isolation device in the at least a portion of the wellbore, wherein the isolation device is positioned after decreasing the temperature, and wherein the wellbore isolation device comprises a substance, wherein the substance:

(i) is a plastic; and (ii) undergoes a phase transition at a phase transition temperature, wherein the temperature of the at least the portion of the wellbore is decreased to a temperature that is less than the phase transition temperature;

(D) causing or allowing the temperature surrounding the wellbore isolation device to increase, wherein the temperature surrounding the wellbore isolation device is increased or allowed to increase after positioning the wellbore isolation device, and wherein the temperature surrounding the wellbore isolation device is increased or allowed to increase to a temperature that is greater than or equal to the phase transition temperature; and (E) allowing at least a portion of the substance to undergo more than one phase transition, wherein the phase transitions are different, wherein the wellbore isolation device is a ball, a wiper plug, or a packer.

19. The method according to claim 18, wherein the step of decreasing comprises introducing a cooling fluid into the at least the portion of the wellbore.

20. A method of hydraulically fracturing at least a portion of a subterranean formation penetrated by a wellbore comprising:

(A) decreasing the temperature of the wellbore penetrating the portion of the subterranean formation;

(B) introducing from a wellhead a ball, a wiper plug, or a packer into the wellbore, the ball, the wiper plug, or the packer being a solid wellbore isolation device at the wellhead;

(C) positioning the wellbore isolation device in the wellbore penetrating the portion of the subterranean formation, wherein the isolation device is positioned after decreasing the temperature, and wherein the wellbore isolation device comprises a substance, wherein the substance:

(i) is a plastic;

(ii) comprises polyglycolic acid; and (iii) undergoes a phase transition at a phase transition temperature, wherein the temperature of the wellbore penetrating the portion of the subterranean formation is decreased to a temperature that is less than or equal to the phase transition temperature;

(D) creating one or more fractures in the portion of the subterranean formation;

(E) causing or allowing the temperature surrounding the wellbore isolation device to increase, wherein the temperature surrounding the wellbore isolation device is increased or allowed to increase after creating the one or more fractures, and wherein the temperature surrounding the wellbore isolation device is increased or allowed to increase to a temperature that is greater than the phase transition temperature; and (F) allowing at least a portion of the substance to undergo the phase transformation, wherein the wellbore isolation device is a ball, a wiper plug, or a packer.

* * * * *